US008845360B2

(12) United States Patent
Ohyama

(10) Patent No.: US 8,845,360 B2
(45) Date of Patent: Sep. 30, 2014

(54) TERMINAL CONNECTION DEVICE

(75) Inventor: Kouichi Ohyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 49 days.

(21) Appl. No.: 13/634,944

(22) PCT Filed: Mar. 15, 2011

(86) PCT No.: PCT/JP2011/056100

§ 371 (c)(1),
(2), (4) Date: Sep. 14, 2012

(87) PCT Pub. No.: WO2011/115134

PCT Pub. Date: Sep. 22, 2011

(65) Prior Publication Data

US 2013/0012056 A1 Jan. 10, 2013

(30) Foreign Application Priority Data

Mar. 17, 2010 (JP) ..... 2010-060093

(51) Int. Cl.
*H01R 3/00* (2006.01)

(52) U.S. Cl.
USPC ..... 439/499

(58) Field of Classification Search
USPC ..... 439/492–499
See application file for complete search history.

(56) References Cited

U.S. PATENT DOCUMENTS 4,948,379 A 8/1990 Evans
6,464,534 B1 * 10/2002 Schramme et al. ..... 439/492
6,558,186 B1 * 5/2003 LePottier et al. ..... 439/496
6,626,698 B2 * 9/2003 Matsumura ..... 439/496
6,659,794 B2 * 12/2003 Yamatani et al. ..... 439/495
6,695,642 B2 * 2/2004 Shindo et al. ..... 439/495
6,699,066 B2 * 3/2004 Wu ..... 439/495
6,733,326 B2 * 5/2004 Lee ..... 439/495
6,749,459 B2 * 6/2004 Urbaniak et al. ..... 439/496

(Continued)

FOREIGN PATENT DOCUMENTS

CN 1391315 A 1/2003
JP 329279 A 2/1991
JP 2006085989 A 3/2006
JP 2007317581 A 12/2007

OTHER PUBLICATIONS

International Search Report dated Apr. 12, 2011 issued in International Application No. PCT/JP2011/056100 (PCT/ISA/210).

(Continued)

*Primary Examiner* — Ross Gushi
(74) *Attorney, Agent, or Firm* — Sughrue Mion, PLLC

(57) ABSTRACT

Provided is a terminal connection device capable of suppressing deflection of a flexible integrated wiring. A terminal connection device for connecting a terminal portion of a flexible integrated wiring to a connector includes a first member having a mounting portion capable of mounting thereon the terminal portion, and an inclined portion formed in a rear end portion thereof located in an extending direction of the flexible integrated wiring; and a second member having a pressing portion formed so as to press the terminal portion, and a bending portion formed on a rear end portion located in the extending direction and formed along the inclined portion of the first member. The second member is formed so as to be attached to the first member in a state where the pressing portion presses the terminal portion and the bending portion bends the flexible integrated wiring along the inclined portion.

4 Claims, 11 Drawing Sheets

(56) References Cited

U.S. PATENT DOCUMENTS

| | | | | |
|---|---|---|---|---|
| 6,755,683 | B2 * | 6/2004 | Roberts et al. | 439/496 |
| 6,780,046 | B2 * | 8/2004 | Bach et al. | 439/495 |
| 6,840,797 | B2 * | 1/2005 | Ueda et al. | 439/495 |
| 7,029,320 | B2 * | 4/2006 | Maejima | 439/495 |
| 7,114,988 | B2 * | 10/2006 | Sato et al. | 439/492 |
| 7,140,909 | B2 * | 11/2006 | Moritake | 439/492 |
| 7,172,455 | B2 * | 2/2007 | Pabst et al. | 439/496 |
| 7,232,334 | B2 * | 6/2007 | Shimizu et al. | 439/496 |
| 7,430,801 | B2 * | 10/2008 | Iida et al. | 29/883 |
| 7,435,131 | B1 * | 10/2008 | Lee | 439/495 |
| 7,465,186 | B2 * | 12/2008 | Yotsutani | 439/497 |
| 7,481,668 | B2 * | 1/2009 | Chiang | 439/492 |
| 7,618,282 | B2 * | 11/2009 | Wu et al. | 439/496 |
| 7,658,640 | B2 * | 2/2010 | Nakazawa et al. | 439/498 |
| 7,674,134 | B2 * | 3/2010 | Yamaji et al. | 439/607.53 |
| 7,682,184 | B2 * | 3/2010 | Ko et al. | 439/495 |
| 8,011,932 | B2 * | 9/2011 | Bertsch et al. | 439/59 |
| 8,579,649 | B2 * | 11/2013 | Ohyama | 439/374 |
| 8,585,433 | B2 * | 11/2013 | Honda | 439/499 |
| 2002/0013086 | A1 * | 1/2002 | Inoue | 439/495 |
| 2002/0146932 | A1 * | 10/2002 | Yamatani et al. | 439/495 |
| 2002/0187674 | A1 | 12/2002 | Hirose | |
| 2003/0013341 | A1 * | 1/2003 | Urbaniak et al. | 439/496 |
| 2003/0060079 | A1 * | 3/2003 | LePottier et al. | 439/492 |
| 2003/0073345 | A1 * | 4/2003 | LePottier et al. | 439/496 |
| 2003/0211773 | A1 * | 11/2003 | Ishii | 439/495 |
| 2003/0220013 | A1 * | 11/2003 | Lee | 439/495 |
| 2003/0236025 | A1 * | 12/2003 | Wu | 439/495 |
| 2004/0002255 | A1 * | 1/2004 | Ueda et al. | 439/495 |
| 2004/0067679 | A1 * | 4/2004 | Maejima | 439/495 |
| 2004/0235339 | A1 * | 11/2004 | Sato et al. | 439/492 |
| 2005/0233632 | A1 * | 10/2005 | Hsu et al. | 439/495 |
| 2005/0255742 | A1 * | 11/2005 | Shih | 439/492 |
| 2006/0019529 | A1 * | 1/2006 | Ko | 439/497 |
| 2006/0035515 | A1 * | 2/2006 | Pabst | 439/492 |
| 2006/0110973 | A1 * | 5/2006 | Moritake | 439/492 |
| 2006/0134969 | A1 * | 6/2006 | Takaku et al. | 439/495 |
| 2006/0141853 | A1 * | 6/2006 | Pabst | 439/495 |
| 2006/0148308 | A1 * | 7/2006 | Pabst et al. | 439/495 |
| 2006/0148309 | A1 * | 7/2006 | Sakurai et al. | 439/495 |
| 2006/0252300 | A1 * | 11/2006 | Sato et al. | 439/492 |
| 2006/0252301 | A1 | 11/2006 | Matsuoka | |
| 2007/0010124 | A1 * | 1/2007 | Ko | 439/492 |
| 2008/0009180 | A1 * | 1/2008 | Ikuta et al. | 439/495 |
| 2008/0200062 | A1 * | 8/2008 | Huang et al. | 439/494 |
| 2008/0214044 | A1 * | 9/2008 | Ko et al. | 439/499 |
| 2008/0305678 | A1 * | 12/2008 | Chiang | 439/492 |
| 2009/0004910 | A1 * | 1/2009 | Takahira | 439/495 |
| 2012/0129400 | A1 * | 5/2012 | Ohyama | 439/626 |
| 2012/0322277 | A1 * | 12/2012 | Ohyama | 439/76.1 |
| 2013/0005172 | A1 * | 1/2013 | Ohyama | 439/350 |
| 2013/0012056 | A1 * | 1/2013 | Ohyama | 439/492 |

OTHER PUBLICATIONS

Written Opinion dated Apr. 12, 2011 issued in International Application No. PCT/JP2011/056100 (PCT/ISA/237).

First Office Action in Chinese Application No. 201180014364X dated Jul. 18, 2014.

* cited by examiner

TERMINAL CONNECTION DEVICE

CROSS-REFERENCE TO RELATED APPLICATIONS

This is a national stage entry of International Application No. PCT/JP2011/056100 filed Mar. 15, 2011, which claims the benefit of Application No. JP 2010-060093 filed Mar. 17, 2010, in the Japanese Patent Office (JPO), the disclosure of which are incorporated herein in its entirety by reference.

TECHNICAL FIELD

The present invention relates to a terminal connection device, particularly, to a terminal connection device for a flexible integrated wiring.

BACKGROUND ART

The wiring used to interconnect electronic devices employs a flexible integrated wiring system such as a flexible flat cable (hereinafter, referred to as "FFC"), or a flexible printed circuit board (hereinafter, referred to as "FPC") and the like in order to improve the degree of freedom in wiring route.

For example, the FFC is formed of a plurality of foil-like conductors with insulating films sandwiched there-between, in both ends thereof is provided with a terminal portion for connection to other electrical circuits. Also, in order to connect an external electrical circuit and an electrical circuit that is formed on a flexible substrate, the FPC includes a terminal portion consisting of a plurality of foil-like conductors at the edge of a circuit board. Such a flexible integrated wiring is usually connected to the electrical circuit via a detachable connector.

However, since the flexible integrated wiring is low in stiffness at the terminal portion thereof, there is a case of resulting in lack of insertion due to the deformation thereof caused by an insertion resistance when being connected to a connector. Therefore, the flexible integrated wiring includes a terminal connection device attached to the terminal portion thereof and is connected to the connector through the terminal connection device (for example, see Patent Document 1).

For example, the terminal connection device described in Patent Document 1 includes a mounting portion for mounting the terminal portion of the flexible integrated wiring, and a slider having engagement portions provided at both ends of the mounting portion and a cover member that has a counter engagement portion engageable to the engagement portion, to press the terminal portion of the flexible integrated wiring towards the mounting portion side of the slider. The flexible integrated wiring is attached to the terminal connection device, by placing the terminal portion on the mounting portion of the slider and engaging the counter engagement portion of the cover member subject to the engagement portion of the slider, in a state of being pressed against the cover member is attached.

PRIOR ART DOCUMENT

Patent Documents

Patent Document 1: Japanese Patent Application Publication No. 2006-85989

SUMMARY OF INVENTION

Problems to Be Solved by Invention

Incidentally, there is a case where, after the flexible integrated wiring is mounted, the terminal connection device described above may be used by folding the flexible integrated wiring according to a mounting condition in a system or a use method thereof. In this case, the deflection in the flexible integrated wiring occurs. In the event of the deflection in the flexible integrated wiring aggregation, adhesion between the slider and flexible integrated wiring is reduced, the reliability of the electrical connection of the flexible integrated wiring when connecting to the connector is reduced. In addition, in the interconnection with the mating connector, there is likely to cause poor fit.

Accordingly, for example, it may consider increasing the thickness of the cover member for pressing the flexible integrated wiring so as not to deflect the flexible integrated wiring, thereby improving the rigidity of the cover member. However, there is a limit in the thickness of the cover member when connected to the connector. Therefore, there are many difficulties setting the thickness of the cover member to a suitable thickness thereof.

An object of the present invention is to provide a terminal connection device capable of suppressing the deflection of a flexible integrated wiring.

Means for Solving Problems

The above-described object of the present invention is achieved by the following configuration.

(1) A terminal connection device for connecting a terminal portion of a flexible integrated wiring to a connector includes a first member having a mounting portion capable of mounting thereon the terminal portion of the flexible integrated wiring, and an inclined portion formed in a rear end portion located in an extending direction of the flexible integrated wiring that the terminal portion is mounted on the mounting portion; and a second member having a pressing portion formed so as to press the terminal portion, and a bending portion formed on a rear end portion located in the extending direction of the flexible integrated wiring that the terminal portion is mounted on the mounting portion and formed along the inclined portion of the first member, wherein the second member is formed so as to be mountable to the first member in a state where the pressing portion presses the terminal portion and the bending portion bends the flexible integrated wiring along the inclined portion.

(2) The terminal connection device according to the configuration of the above (1), wherein the bending portion is formed on a front end thereof with a first rib portion capable of pressing the flexible integrated wiring that the terminal portion is mounted on the mounting portion.

(3) The terminal connection device according to the configuration of the above (1) or (2), wherein an engagement portion of the first member is formed in a substantially cylindrical shape, and wherein a counter engagement portion of the second member is formed so as to be engaged with the engagement portion so that the second member is rotatable with respect to the engagement portion.

(4) The terminal connection device according to the configuration of the above (1) or (2), wherein the first member is provided with a second rib portion formed on the rear end portion, and wherein the second member is provided with a mounting regulation portion formed so that the second rib portion is mountable thereon.

MODE TO CARRY OUT INVENTION

Hereinafter, the terminal connection device 1, 1A according to the illustrative embodiments of the invention will be described with reference to the accompanying drawings. The terminal connection device 1, 1A according to the embodiment of the present invention is used when a FFC 100 as a flexible integrated wiring is connected to a connector (not shown) for connecting an electrical circuit. That is, the FFC100 is connected to a connector for connection to an electric circuit via the terminal connection device 1, 1A. The FFC100 is connected to the connector via the terminal connection device 1, 1A whereby the lack of insertion to the connector is suppressed, and the reliability of electrical connection at the time of connection to the connector may be improved.

Hereinafter, the terminal connection device 1, 1A according to embodiments of the present invention will be described in detail.

First Embodiment

First, the terminal connection device 1 according to the first embodiment of the present invention will be described with reference to FIG. 1 to FIG. 5D.

Figure 1:
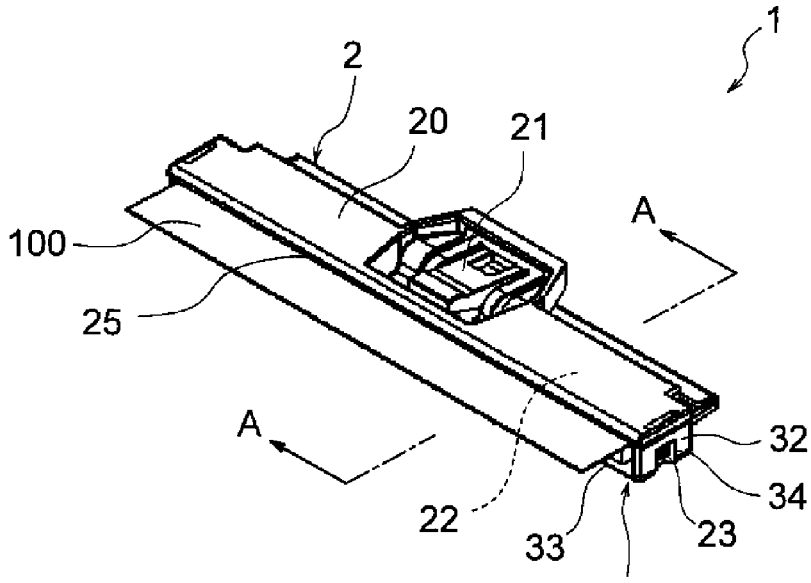
FIG. 1 is a perspective view of showing an appearance of a terminal connection device according to a first illustrative embodiment of the present invention.
Figure 2:
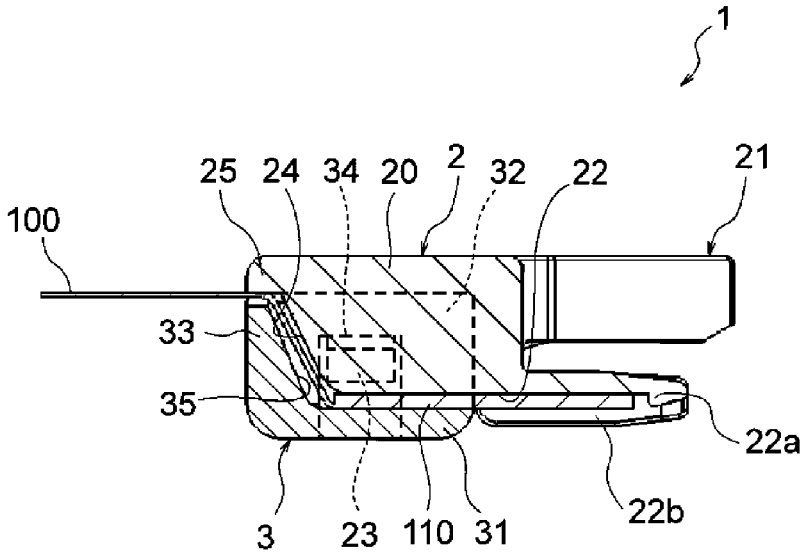
FIG. 2 is a cross-sectional view taken along A-A of the terminal connection device shown in FIG. 1.
Figure 3:
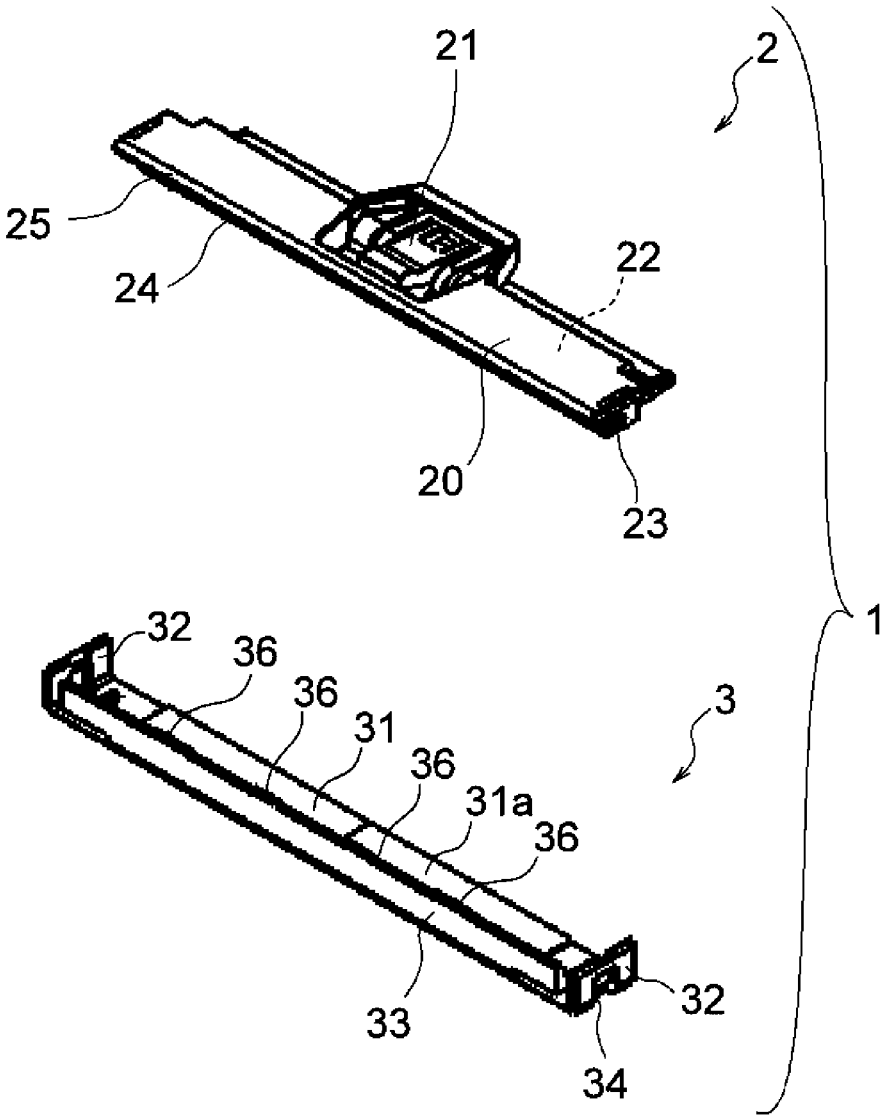
FIG. 3 is an assembly view showing the terminal connection device according to the first illustrative embodiment.
Figure 4A:
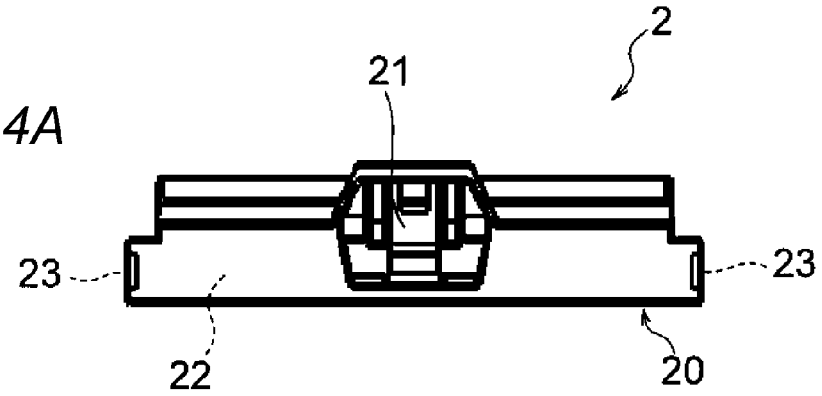
FIG. 4A is a plan view showing a slider according to the first illustrative embodiment.
Figure 4B:
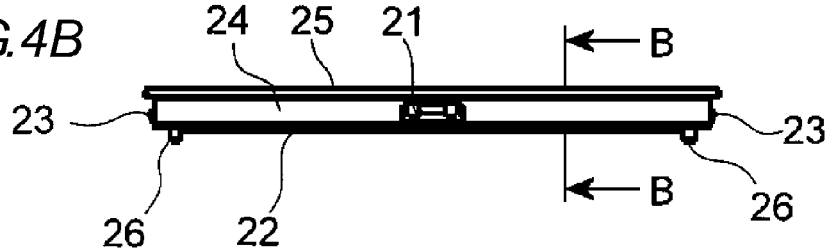
FIG. 4B is a front view of the slider shown in FIG. 4A.
Figure 4C:
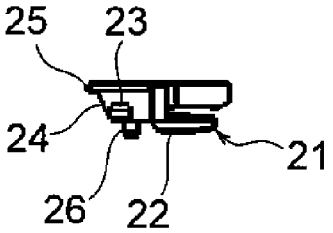
FIG. 4C is a side view of the slider shown in FIG. 4A.
Figure 4D:
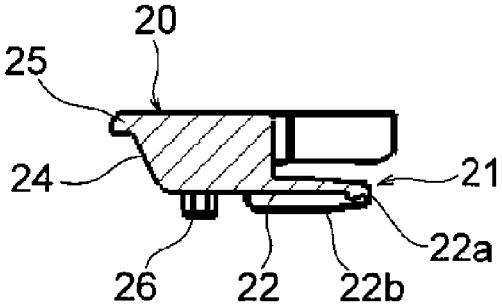
FIG. 4D is a cross-sectional view taken along B-B of the slider shown in FIG. 4B.
Figure 5A:
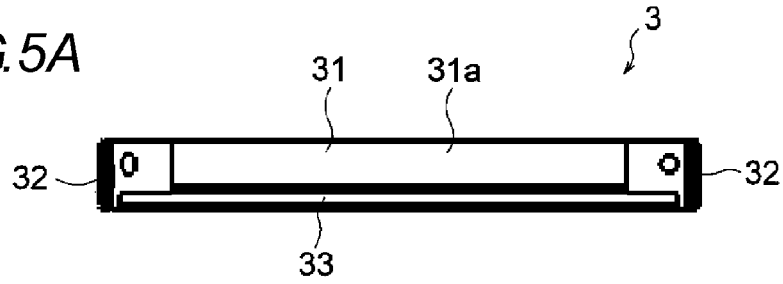
FIG. 5A is a plan view showing a cover member according to the first illustrative embodiment.
Figure 5B:
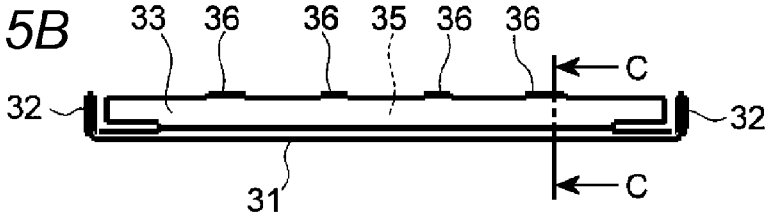
FIG. 5B is a front view of the cover member shown in FIG. 5A.
Figure 5C:
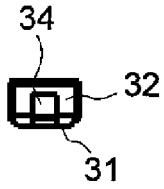
FIG. 5C is a side view of the cover member shown in FIG. 5A.
Figure 5D:
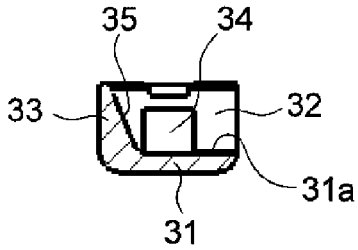
FIG. 5D is a cross-sectional view taken along C-C of the cover member shown in FIG. 5B.

FIG. 1 is a perspective view showing an appearance of the terminal connection device 1 according to the first embodiment of the present invention. FIG. 2 is a cross-sectional view taken along A-A of the terminal connection device shown in FIG. 1. FIG. 3 is a diagram showing an assembly of the terminal connection device according to the first embodiment. FIG. 4A is a plan view of the slider 2 according to the first embodiment. FIG. 4B is a front view of the slider 2 shown in FIG. 4A. FIG. 4C is a side view of the slider 2 shown in FIG. 4A. FIG. 4D is a cross-sectional view taken along B-B of the slider 2 shown in FIG. 4B. FIG. 5A is a plan view of the cover member 3 according to the first embodiment. FIG. 5B is a front view of the cover member 3 shown in FIG. 5A. FIG. 5C is a side view of the cover member 3 shown in FIG. 5A. FIG. 5D is a cross-sectional view taken along C-C of the cover member 3 shown in FIG. 5B.

As shown in FIG. 1 to FIG. 3, the terminal connection device 1 according to the first embodiment includes a slider 2 that is fitted to a connector (not shown) for being connected to a electric circuit, and a cover member 3 that is mounted on the slider 2.

In addition to FIG. 1 to FIG. 3, as shown in FIG. 4A to FIG. 4D, the slider as the first member is provided with a slider body 20 formed so that the FFC100 may be arranged, and a fitting portion 21 formed so as to be fitted into a connector. The slider body 20 is formed in an approximately rectangular shape. In addition, the slider body 20 is provided with a mounting portion 22, an engagement portion 23, an inclined portion 25, a guide portion 25, and a pair of boss portions 26, 26.

The mounting portion 22 is provided on one side of the slider body 20 (for example, the lower side in the figure). The mounting portion 22 is formed so that the terminal portion 110 of the FFC 100 can be placed thereon. In addition, the mounting portion 22 is provided with a pair of sidewall portions 22*b*, 22*b*, and a projecting end 22*a*. The pair of side wall portions 22*b*, 22*b* is formed on both sides of the tip portion side of the mounting portion 22 (the front end of the slider body 20). The pair of sidewall portions 22*b*, 22*b* regulates both sides (both sides in the width direction of the FFC100) of the terminal portion 110 of the FFC100 arranged on the mounting portion 22. In addition, the pair of sidewall portions 22*b*, 22*b* guides the terminal portion 110 to a predetermined position (hereinafter, referred to as "mounted position") of the mounting portion 22. The projection end 22*a* is formed on the tip of the mounting portion 22. The projecting end 22*a* regulates the tip side of the terminal portion 110 arranged on the mounting portion 22. In addition, the projecting end 22*a* guides the tip of the terminal portion 110 to a predetermined position of the mounting portion 22.

The engagement portion 23 is provided on both sides (on surface located on both sides in the lengthwise direction of the mounting section 22) of the slider body 20. The engagement portion 23 protrudes from the side thereof and formed in the shape of nails.

The inclined portion 24 is provided on a rear side (on surface located on the rear end side of an opposite side from the tip of the mounting section 22) of the slider body 20. The inclined portion 24 is formed so that the inclined portion 24 may be inclined (inclined in an upper direction), from one side (for example, lower side in the figure) at which the mounting portion 22 is formed towards the other side (for example, upper side in the figure).

The guide portion 25 is formed at the upper end (the end portion of the plane of the other side) of the inclined portion 24 so as to protrude approximately parallel to the mounting portion 22. The guide portion 25 is mounted on the mounting portion 22 to guide the FFC 100 placed along the inclined portion 24 so as to be extended approximately parallel to the mounting portion 22 from the inclined portion 24.

A pair of boss portions 26 and 26 is formed to protrude from the mounting portion 22. The pair of boss portions 26 and 26 is formed so as to pass through a pair of boss holes (not shown) formed in the terminal portion 110 of the FFC100 placed on the mounting portion 22.

The fitting portion 21 is formed so as to be fitted into a counter fitting portion (not shown) formed in a connector.

In addition to FIG. 1 to FIG. 3, as shown in FIG. 5A to FIG. 5D, the second cover member 3 as a second member includes the pressing portion 31 capable of pressing the FFC100 placed on the mounting portion 22, a pair of arm portions 32, 32 capable of being engaged with the slider body 20, and a bending portion 33 formed along (substantially parallel) the inclined portion 24 when mounted to the slider body 20. The cover member 3 is formed so as to be substantially L-shaped in its cross-sectional shape by the bending portion 33 and the pressing portion 31.

The pressing portion 31 is formed in the shape of a substantially rectangular plate, and is formed so as to match in its lengthwise direction the width direction of the terminal portion 110 of the FFC100 that is placed in the mounting portion 22. In addition, the pressing portion 31 has a pressing surface 31*a*. The pressing surface 31*a* serves to press the terminal portion 110 of FFC100 placed on the mounting portion 22.

The pair of arm portions 32, 32 are formed so as to be suspended along the side of the slider body 20 from both ends thereof in the lengthwise direction (the width direction of the terminal unit 110) of the pressing portion 31. In addition, the pair of arm portions 32, 32 is provided with a counter engagement portion 34 capable of being engaged with the engagement portion 20 formed on the side of the slider body. The counter engagement portion 34 is formed to be engaged with the engaging portion 23 that protrudes from the side thereof in a claw-shape. In addition, the counter engagement portion 34 is formed in a state of passing through the arm portion 32.

The bending portion 33 is formed in the shape of a substantially rectangular plate, which is connected to a side edge portion (the side edge of the rear end side in a terminal connection device 1) of one side extending in the lengthwise direction of the pressing portion 31. Also, the bending portion 33 is provided with an inclined surface 35, and a plurality of cover rib portions 36 as a first rib portion. In a case where the cover member 3 is mounted on the slider body 20, the inclined surface 35 is formed so as to be opposed to (face) the inclined portion 24 in a state of being arranged along the inclined portion 24 of the slider body 20. In other words, the inclined surface 35 is formed so as to be positioned substantially parallel to the inclined portion 24 in a state of being spaced a predetermined distance from the inclined portion 24.

The plurality of rib portions 36 is formed to protrude from the tip (the side opposite to the side (the base end) connected to the side edge of the pressing portion 31) of the bending portion 33.

Next, the action of a terminal connection device 1 according to the first embodiment will be described with reference to FIG. 6B and FIG. 6B.

Figure 6A:
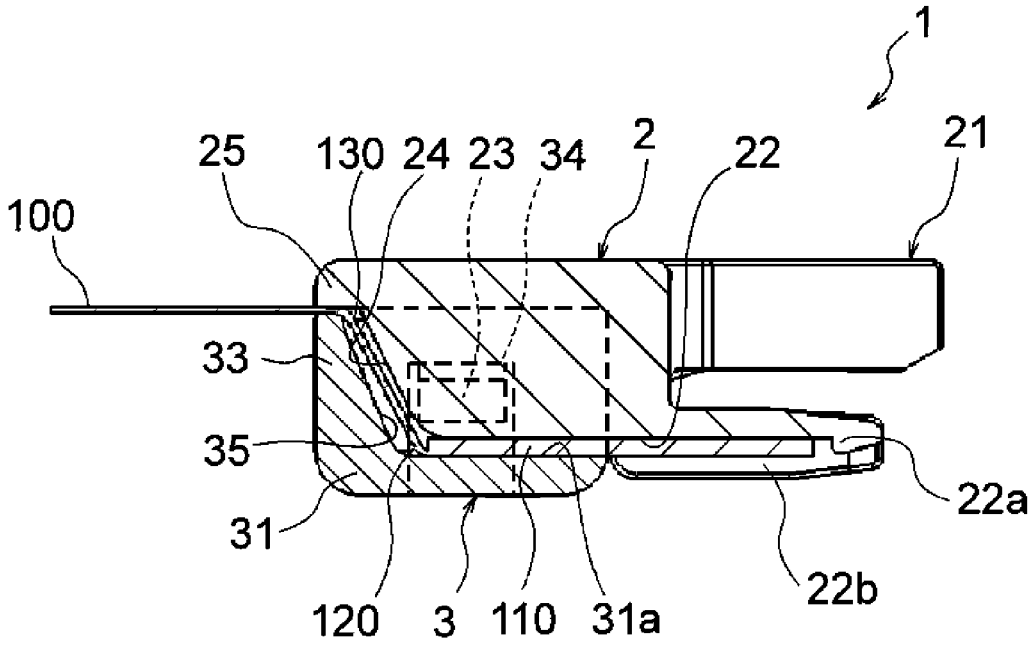
FIG. 6A is a cross-sectional view illustrating an operation of the terminal connection device according to the first embodiment.

FIG. 6A is a cross-sectional view illustrating the action of the terminal connection device 1 according to the first embodiment. FIG. 6B is a partial enlarged sectional view of the terminal connection device 1 shown in FIG. 6A.

First, the terminal portion 110 of the FFC 100 is mounted on the mounting portion 22 of the slider body 20. In more detail, the terminal portion 110 is arranged between a pair of side wall portions 22*b*, 22*b* provided on the mounting portion 22. After the terminal portion 110 is mounted between the pair of sidewall portions 22*b*, 22*b*, the terminal portion 110 is moved to the tip portion side of the slider body 20 along the pair of side wall portions 22*b*, 22*b*. When the terminal portion 110 is moved to the tip portion side, the tip portion of the terminal unit 110 hits the projecting end 22*a* provided on the side of the tip of the mounting portion 22. When the tip of the terminal portion 110 strikes the projecting end 22*a*, the terminal portion 110 is arranged in a predetermined mounting position.

If the terminal portion 110 is mounted at a predetermined position, a pair of boss portions 26, 26 provided on the mounting portion 22 is inserted into a pair of boss holes (not shown) formed at both ends thereof in the width direction of FFC100. The terminal portion 110 is held in a predetermined position of the mounting portion 22.

Then, the cover member 3 is arranged in an upper direction of the slider body 20 so that the FFC100 is inserted between the cover member 22 of the slider body 20 and the pressing portion 31 of the cover member 3. After the cover member 3 is placed in the upper direction of the slider body 20, the terminal portion 110 of the FFC 100 is pressed towards the mounting portion 22 side by the pressing portion 31 of the cover member 3. After the terminal portion 110 is pressed by the pressing portion 31, the counter engagement portion 34 formed in the pair of arm portions 32, 32 of the cover member 3 is engaged with the engagement portion 23 formed at a side surface of the slider body 20. Accordingly, the cover member 3 is fixed to the slider body 20.

At this time, the terminal portion 110 of the FFC100, as shown in FIG. 6A, is held in the cover member 3 in a state of being pressed against the pressing portion 31. On the other hand, the FFC 100 (a first crank bending portion 120) that is continuous with the terminal portion 110 is bent in a crank shape by the inclined portion 24 of the slider body 20 and the bending portion 33 of the cover member 3. Likewise, the FFC100 (second crank bending portion 130) is bent in the shape of a crank by the end portion of the bending portion 33 of the cover member 3 and the guide portion 25 of the slider body 20.

In the FFC100 bent in the shape of a crank at the first crank bending portion 120 and second crank bending portion 130 thereof, the front side (the terminal portion 110 side as the front side of the first crank bending portion 120) of the portion bent in a crank shape is hardly deflected even though the FFC 100 is bent in various directions at the rear side (rear side of the second crank bending portion 130) of the portion bent in a crank shape thereof.

In addition, the FFC100 is bent, in the second crank bending portion 130 thereof, in the shape of a crank by the guide portion 25 of the slider body 20 and the end portion of the bending portion 33 of the cover member 3, thereafter being extended substantially parallel to the mounting portion 22 by the guide portion 25.

Figure 6B:
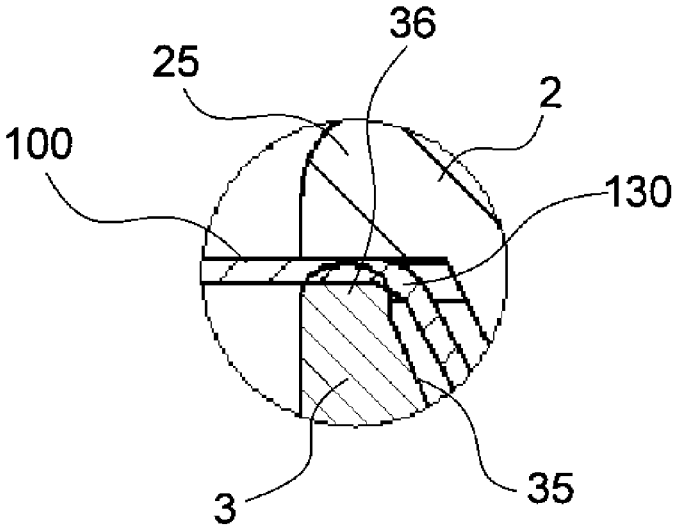
FIG. 6B is a partial enlarged cross-sectional view of the terminal connection device shown in FIG. 6A.

In addition, as shown in FIG. 6B, the FFC100 extending from the guide portion 24 is pressed against the plurality of cover rib portions 36 formed at the tip portion of the bending portion 33 of the cover member 3, and is firmly held (fixed) to the slider body 20.

The terminal connection device 1 according to the first embodiment, which has the configuration as described above, represents the following effects.

The terminal connection device 1 according to the first embodiment is provided with the cover member 4 having the pressing portion 31 capable of pressing the terminal portion 110 of FFC100 and the bending portion 33 formed along the inclined portion 24 of the slider body 20. The cover member 4 is formed in a substantially L-shape when viewed from its cross sectional plane crossing at right angles with the lengthwise direction thereof, by the pressing portion 31 and the bending portion 33. Therefore, it is possible to improve the rigidity of the cover member 4 in the lengthwise direction thereof. Thus, it is possible to suppress the deflection in the lengthwise direction of the cover member 4. As a result, it becomes possible to press the terminal portion 110 of the FFC100 in the state the deflection thereof is suppressed (in a state that the rigidity thereof has been improved), thereby preventing the terminal portion 110 from being deflected.

Also, the bending portion 33 of the cover member 4 is formed along the inclined portion 24 of the slider body 20 when mounted to the slider body 20. Therefore, the FFC 100 may be bent in a crank shape (first crank bending portion 120 and second crank bending portion 130) by the pressing portion 31 and the bending portion 33 of the cover member 4 and the inclined portion 24 and the guide portion 25 of the slider body 20. Accordingly, the front side and rear side (the front side of the first bending portion 120 and the rear side of the crank bending portion 130) of the portion of the FFC 100 bent in a crank shape my not be influenced by the deflection of the FFC 100. As a result, for example, even in the case where the rear side (rear side of the second crank bending portion 130) of the FFC 100 bent in the shape of a crank is wired in a state where the FFC100 has been bent, the front side (front side portion of the first crank bending portion 120) bent in the crank shape may be prevented from being deflected due to the bending of the FFC 100.

In addition, the terminal connection device 1 according to the first embodiment is provided with a plurality of cover rib portions 36 at the tip of the bending portion 33 of the cover member 4. Therefore, the terminal connection device 1 may press firmly the FFC100. Accordingly, the terminal connection device 1 serves to firmly hold (fix) the FFC 100 in the slider body 20. As a result, the terminal portion 110 of the FFC100 can be prevented from being deflected due to bending of FFC100.

Second Embodiment

Next, the terminal connection device 1A according to the second embodiment of the present invention will be described with reference to FIG. 7 to FIG. 11D.

Figure 7:
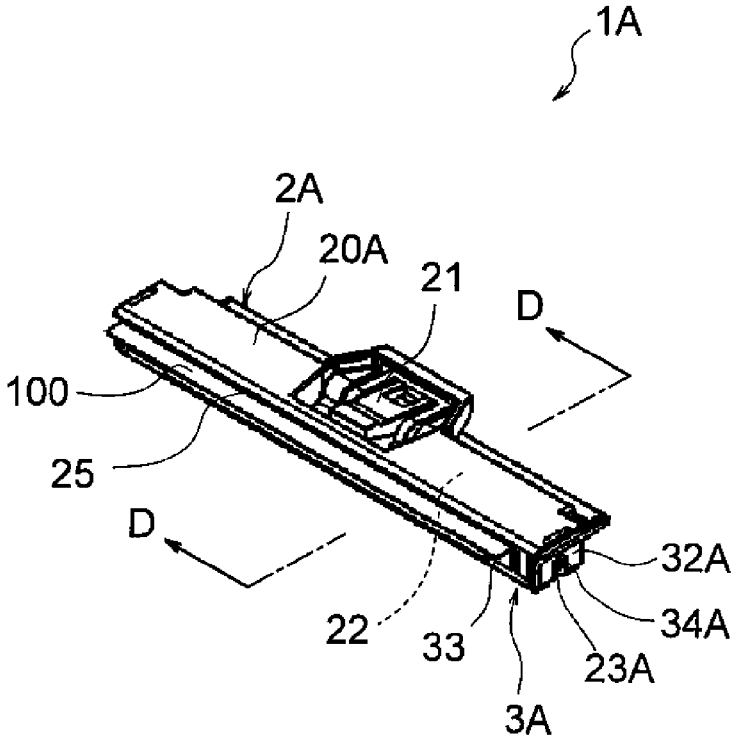
FIG. 7 is a perspective view showing an appearance of the terminal connection device according to a second illustrative embodiment of the present invention.
Figure 8:
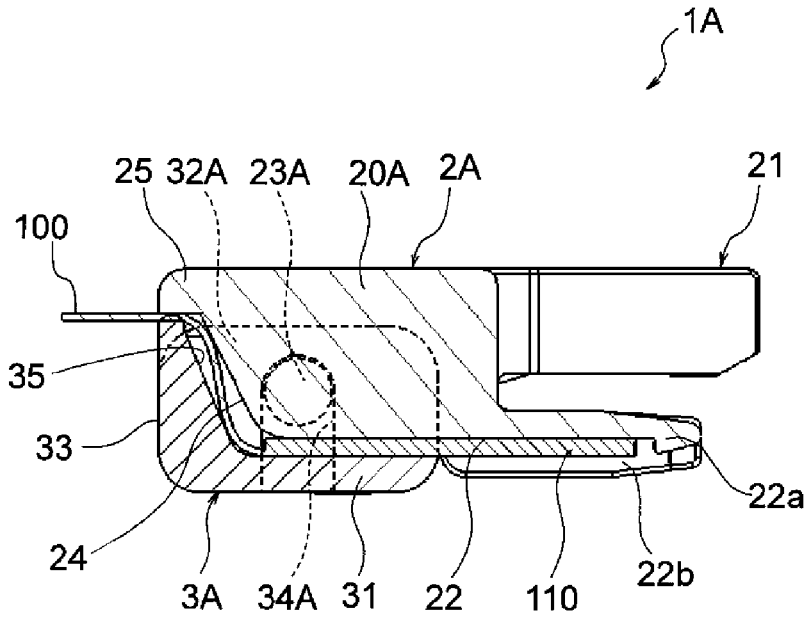
FIG. 8 is a cross-sectional view taken along D-D of the terminal connection device shown in FIG. 7.
Figure 9:
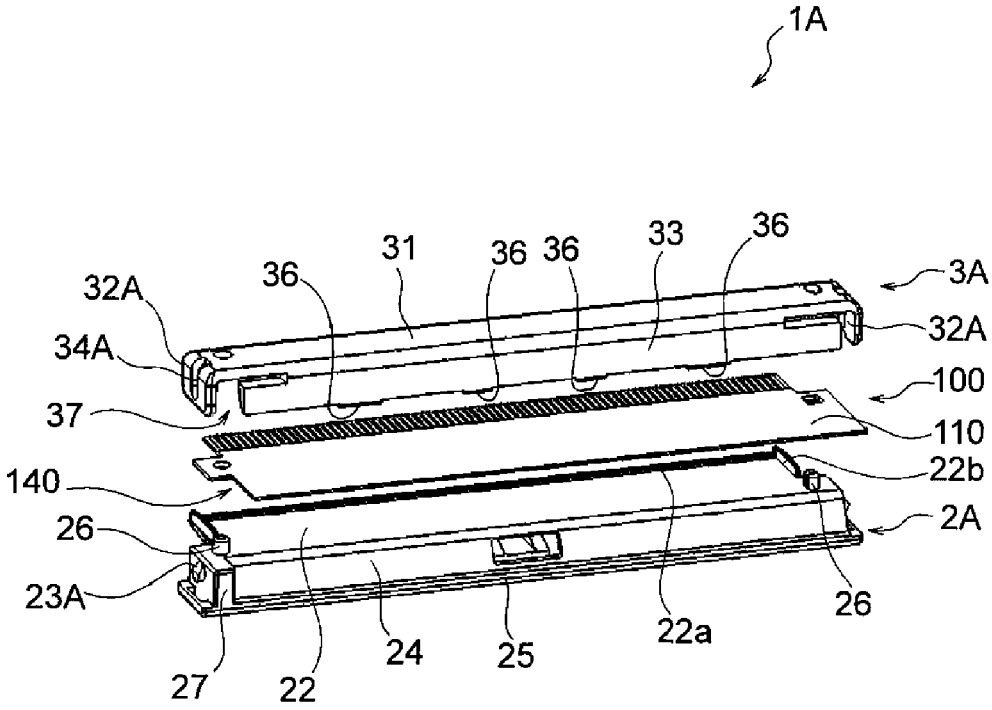
FIG. 9 is an assembly view of the terminal connection device according to the second embodiment.
Figure 10A:
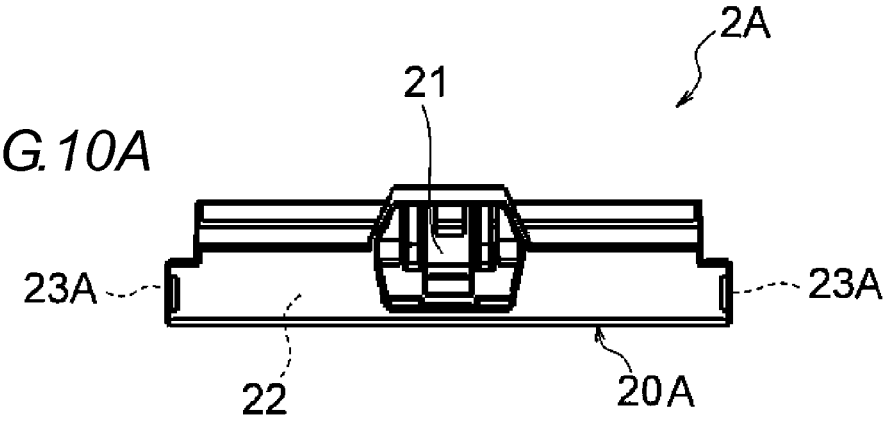
FIG. 10A is a plan view showing a slider according to the second illustrative embodiment.
Figure 10B:
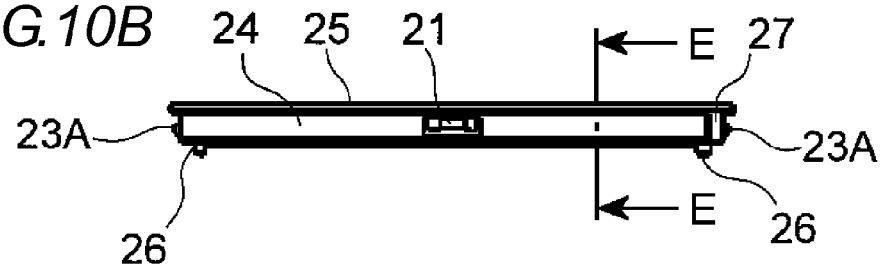
FIG. 10B is a front view of the slider shown in FIG. 10A.
Figure 10C:
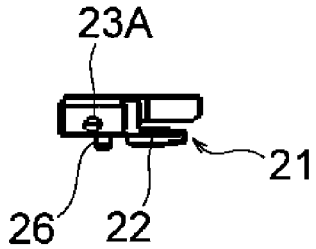
FIG. 10C is a side view of the slider shown in FIG. 10A.
Figure 10D:
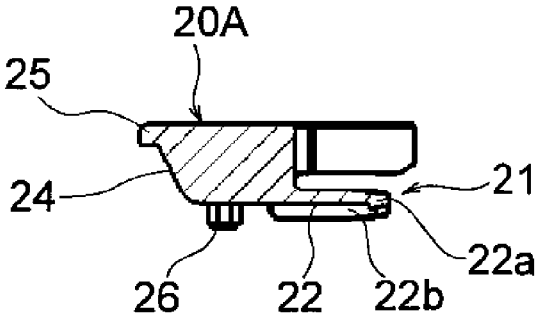
FIG. 10D is a cross-sectional view taken along E-E of the slider shown in FIG. 10B.
Figure 11A:
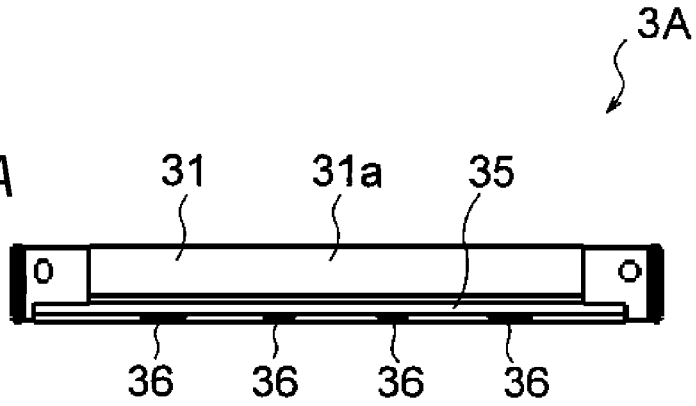
FIG. 11A is a plan view showing a cover member according to the second illustrative embodiment.
Figure 11B:
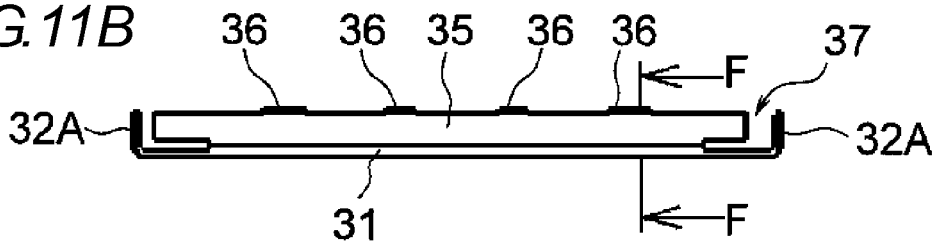
FIG. 11B is a front view of the cover member shown in FIG. 11A.
Figure 11C:
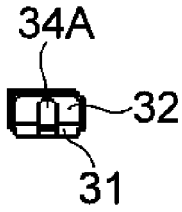
FIG. 11C is a side view of the cover member shown in FIG. 11A.
Figure 11D:
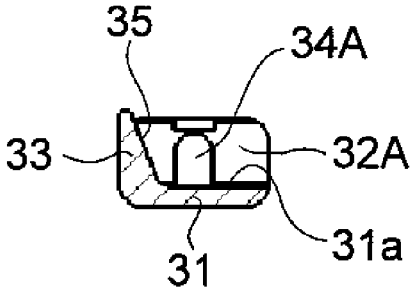
FIG. 11D is a cross-sectional view taken along F-F of the cover member shown in FIG. 11B.

FIG. 7 is a perspective view showing an appearance of the terminal connection device 1A according to the second illustrative embodiment of the present invention. FIG. 8 is a cross-sectional view taken along D-D of the terminal connection device 1A shown in FIG. 7. FIG. 9 is an assembly view of the terminal connection device 1A according to the second embodiment. FIG. 10A is a plan view showing the slider 2A according to the second illustrative embodiment. FIG. 10B is a front view of the slider 2A shown in FIG. 10A. FIG. 10C is a side view of the slider 2A shown in FIG. 10A. FIG. 10D is a cross-sectional view taken along E-E of the slider 2A shown in FIG. 10B. FIG. 11A is a plan view showing a cover member 3A according to the second illustrative embodiment, FIG. 11B is a front view of the cover member 3A shown in FIG. 11A, FIG. 11C is a side view of the cover member 3A shown in FIG. 11A, and FIG. 11D is a cross-sectional view taken along F-F of the cover member 3A shown in FIG. 11B.

The terminal connection device 1A according to the second embodiment is different from the terminal connection device 1 according to the first embodiment in that the cover member 3A is mounted rotatably with respect to the slider 2A. Therefore, in the second embodiment, the cover member 2A and the slider 3A will be described mainly with reference to the differences between the first embodiment and the second embodiment.

Incidentally, in the second embodiment, the same configuration as in the terminal connection device 1 according to the first embodiment will be designated by the same reference numerals, and the description thereof is omitted. Also, in the second embodiment, the same configuration as in the first embodiment has the same effect as in the first embodiment.

As shown in FIG. 7 to FIG. 9, the terminal connection device 1A according to the second embodiment is provided with a slider 2A fitted (connected) to a connector (not shown) for connection to electrical circuitry, and the cover member 3A mountable to the slider 2A.

In addition to FIG. 7 to FIG. 9, as shown in FIG. 10A to FIG. 10D, the slider 2A as the first member is provided with the slider body 20A formed so that the FFC 100 may be placed thereon and a fitting portion 21 formed to be fitted into the connector.

The slider body 20A is formed in a substantially rectangular parallelepiped shape, and provided with the mounting portion 22, the engagement portion 23A, the guide portion 25, a pair of boss portions 26, 26, and the slider rib portion 27 as a second rib.

The engagement portion 23A each is provided on both sides (surface located on both sides in the lengthwise direction of the mounting portion 22) of the slider body 20A. The engagement portion 23A is formed in a substantially cylindrical shape. The engagement portion 23A has a base end portion connected to the side of the slider body 20A and protrudes in a direction perpendicular to the side of the slider body 20A.

The slider rib portion 27 is formed on one end portion of a rear side (inclined portion 24) of the slider body 20A in the longitudinal direction. The slider rib portion 27 is formed so as to protrude from the inclined portion 24. In addition, in the case where the FFC 100 is arranged on the slider body 20A, the slider rib portion 27 is formed so that the notch portion 140 formed on the terminal portion 110 of FFC100 may be arranged thereon (see FIG. 9).

In addition to FIG. 7 to FIG. 9, as shown in FIG. 11A to FIG. 11D, the cover member 3A as a second member is provided with the pressing portion 31 capable of pressing the FFC100 placed on the mounting portion 22, a pair of arm portions 32A, 32A that is engageable with the slider body 20A, the bending portion 33 formed to comply with the inclined portion 24 when mounted on the slider body 20A, and a mounting regulation portion 37 formed so that the slider rib portion 27 formed on the slider body 20A may be arranged thereon.

The pair of the arm portions 32A, 32A is suspended along the side of the slider body 20A from both ends thereof in the lengthwise direction (the width direction of the terminal portion 110) of the pressing portion 31. In addition, the pair of arm portions 32A, 32A is engaged with the substantially cylindrical engagement portion 23A formed on the side 20A of the slider body 20A, and provided with the counter engagement portion 34A formed to be rotated around the engagement portion 23A. The counter engagement portion 34A is formed passing through the arm portion 32A so as to be engaged with the engagement portion 23A projecting from the side thereof. In addition, the counter engagement portion 34A is formed in a substantially circumferential shape so that the cover member 3A may rotate around the engagement portion 23A formed in an approximately cylindrical shape.

The mounting regulation portion 37 is formed at a position adjacent to the bending portion 33 in the one end portion side thereof in the lengthwise direction of the pressing portion 31. In the case where the cover member 3A is mounted on the slider body 20A, the mounting regulation portion 37 is formed so that the slider rib portion 27 of the slider body 20A may be arranged thereon (see FIG. 13).

Next, the action of the terminal connection device 1A according to the second embodiment will be described with reference to FIG. 12 to FIG. 13B.

Figure 12:
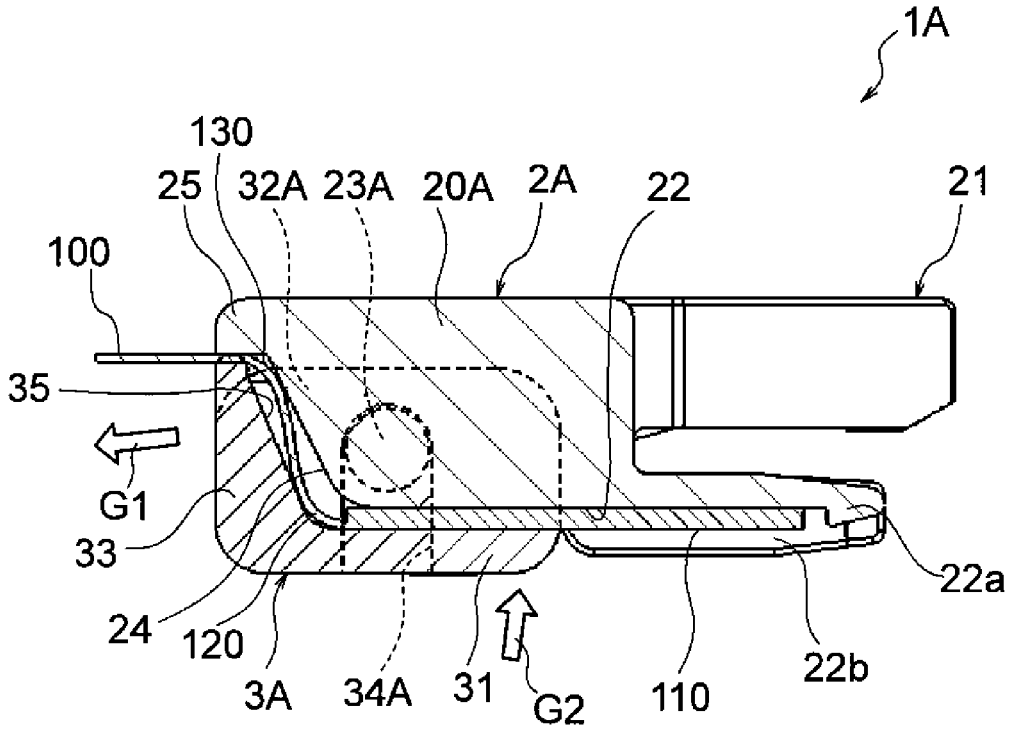
FIG. 12 is a cross-sectional view illustrating an operation of the terminal connection device according to the second embodiment.
Figure 13A:
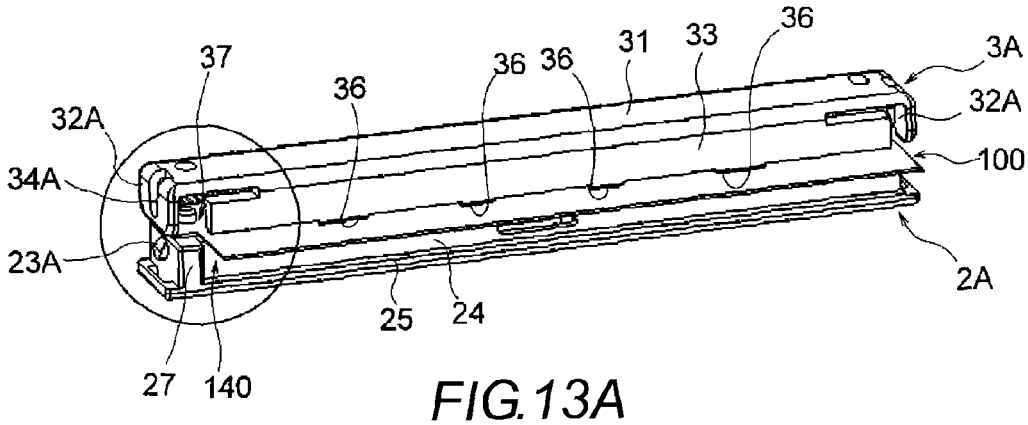
FIG. 13A is an appearance perspective view illustrating an operation of the terminal connection device according to the second embodiment.
Figure 13B:
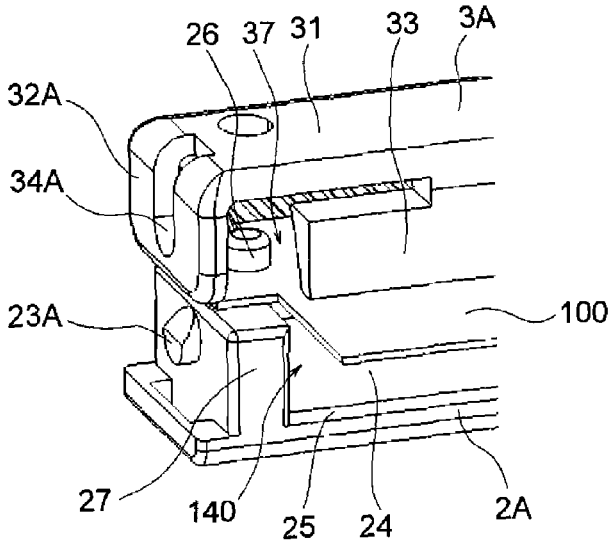
FIG. 13B is a partial enlarged cross-sectional view of the terminal connection device shown in FIG. 13A.

FIG. 12 is a cross-sectional view illustrating an action of the terminal connection device 1A according to the second embodiment. FIG. 13A is an appearance perspective view illustrating an operation of the terminal connection device 1A according to the second embodiment, and FIG. 13B is a partial enlarged cross-sectional view of the terminal connection device 1A shown in FIG. 13A.

Since the configuration of until the cover member 3A is fixed to the slider body 20A is the same as that of the first embodiment, the description thereof will be omitted. As shown in FIG. 13A and FIG. 13B, the terminal connection device 1A includes the slider body 20A provided with the slider rib portion 27 and the cover member 3A provided with the mounting regulation portion 37 on which the slider rib portion 27 may be arranged. Accordingly, for example, if the terminal portion 110 is not placed on the mounting portion 22 in the state that the notch portion 140 formed in the FFC 100, the FFC 100 interferes in the slider rib portion 27, thereafter it is configured in such a manner that the cover member 3A cannot be mounted on the slider body 20A thereafter.

The cover member 3A is fixed to the slider body 20A, as shown in FIG. 12, the terminal portion 110 of the FFC100 110 is held to the cover member 3A in a state of being pressed against the pressing portion 31.

On the other hand, the FFC100 continuous with the terminal portion 110 is bent in the shape of a crank by the bending portion 33 of the cover member 3A and the inclined portion 24 of the slider body 20A (a first crank bending portion 120). Likewise, the FFC100 is bent in the shape of a crank by an end portion of the bending portion 33 of the cover member 3A and the guide portion 25 of the slider body 20A.

At this time, the FFC100 generates the elastic restoring force going back to the original state (flatted state) from the bent state. This elastic restoring force acts in the direction of the arrow G1 shown in FIG. 12, and thereby pressing the bending portion 33 in the direction of the arrow G1.

In addition, the cover member 3A is mounted on the slider body 20A so as to be rotated around the engaging portion 23A. Therefore, the cover member 3A is rotated around the engaging portion 23A by the elastic restoring force of FFC100. When the cover member 3A rotates around the engagement portion 23A, the bending portion 33 is moved in the direction of the arrow G1, and the pressing portion 31 is moved in the direction of the arrow G2. When the pressing portion 31 is moved in the direction of the arrow G2, the pressing portion 31 further presses the terminal portion 110.

The larger the elastic restoring force due to the FFC100, the larger the pressing force at this time. For example, even in the case where the rear side (rear side of the second crank bending portion 130) of the FFC 100 is bent in the crank shape, if the FFC 100 is bent in an upward direction sown in FIG. 12, the pushing force (the arrow G1 shown in FIG. 12) of the FFC 100 towards the bending portion 33 becomes larger. Accordingly, as the force the pressing portion 31 presses the terminal portion 110 increases, the deflection thereof may be suppressed.

On the other hand, for example, even in the case where the rear side (rear side of the second crank bending portion 130) of the FFC 100 is bent the crank shape, if the FFC 100 is bent in the downward direction as shown in FIG. 12, the cover member 3A is pulled downwards, and the force the cover member 3A tries to rotate increases. Accordingly, the force the pressing portion 31 presses the terminal portion 110 increases, and thereby the deflection can be suppressed.

The terminal connection device 1A according to the second embodiment, which has the configuration as described above, has the following effects in addition to the same effect as in the terminal connection device 1 according to the first embodiment.

In the terminal connection device 1A according to the second embodiment of the present invention, the cover member 3A is rotatably mounted to the slider 2A (slider body 20A) around the engaging portion 23A. Therefore, it is possible to use the elastic restoring force (elastic restoring deformation) of the bending of FFC100 to rotate the cover member around the engaging portion 23A. Accordingly, it is possible to press the terminal portion 110 of the FFC by the rotational force of the elastic restoring force. As a result, it is possible to suppress the deflection of the FFC100.

In addition, the slider 2A (slider body 20A) of the terminal connection device 1A according to the second embodiment is provided with the slider rib portion 27 that the notch portion 140 formed on the rear end side of FFC100 may be placed on a rear portion side thereof, and the cover member 3A is provided with the mounting regulation portion 37 that the slider rib portion 27 may be arranged on the bending portion 33. Therefore, in the case where the FFC 100 is mounted in the terminal connection device 1A, if the FFC 100 is arranged on the slider 2A in error (for example, placed upside down), the slider rib portion 27 will interfere in the FFC100 when the cover member is mounted. Accordingly, the cover member 3A cannot be mounted to the slider 2A. As a result, it is possible to prevent the FFC 100 from being mounted in error.

In the foregoing, although the embodiments of the present invention have been described, the present invention is not limited to the embodiments described above. Also, the effects having been described in the embodiments of the present invention are just enumerated as the most preferred effects resulting from the present invention, but the effects of the present invention are not limited to those described in the embodiments of the present invention.

For example, in the present embodiment, the flexible integrated wiring has been described using the FFC100, but the present invention is not limited to this. 1. The terminal connection device 1, 1A may also be used in the flexible integrated wiring such as FPC and the like.

The application is based on Japanese Patent Application No. 2010-060093, filed on Mar. 17, 2010, and the contents of which are incorporated herein by reference.

INDUSTRIAL APPLICABILITY

According to the terminal connection device in accordance with the present invention, since it is possible to suppress the deflection of the flexible integrated wiring, it is possible to easily ensure the reliability of electrical connection of the flexible integrated wiring when connected to a connector without degradation in the adhesion between the first member and the flexible integrated wiring. In addition, in the interconnection with the counter connector, it is easy to prevent a poor fit

DESCRIPTION OF REFERENCE NUMERALS

1, 1A: terminal connection device
2, 2A: slider (first member)
3, 3A: cover member (second member)
20: slider body
22: mounting portion
23, 23A: engagement portion
24: inclined portion
25: guide portion
26: boss portion
27: slider rib portion (second rib portion)
31: pressing portion
32, 32A: arm portion
33: bending portion
34, 34A: counter engagement portion
35: inclined surface
36: cover rib portion (first rib portion)
37: mounting regulation portion
100: FFC (flexible integrated wiring)
110: terminal portion
120: first crank bending portion
130: second crank bending portion

The invention claimed is:

1. A terminal connection device for connecting a terminal portion of a flexible integrated wiring to a connector, comprising:

a first member having a mounting portion capable of mounting thereon the terminal portion of the flexible integrated wiring, and having an inclined portion formed in a rear end portion of the first member, the inclined portion extending from the mounting portion in a same direction as a direction of extension of the flexible integrated wiring when the terminal portion is mounted on the mounting portion; and a second member having a pressing portion formed so as to press the terminal portion, and a bending portion formed on a rear end portion of the second member, the bending portion being formed essentially parallel to the inclined portion of the first member, and the bending portion extending from the mounting portion in the same direction as the direction of extension of the flexible integrated wiring when the terminal portion is mounted on the mounting portion, wherein the second member is formed so as to be mountable to the first member in a state where the pressing portion presses the terminal portion and the bending portion bends the flexible integrated wiring along the inclined portion, wherein an engagement portion of the first member is formed in a substantially cylindrical shape, and wherein a counter engagement portion of the second member is formed so as to be engaged with the engagement portion so that the second member is rotatable with respect to the engagement portion.

2. The terminal connection device according to claim 1, wherein the bending portion is formed on a front end thereof with a first rib portion capable of pressing the flexible integrated wiring that the terminal portion is mounted on the mounting portion.

3. The terminal connection device according to claim 1, wherein the first member is provided with a second rib portion formed on the rear end portion of the first member, and wherein the second member is provided with a mounting regulation portion formed so that the second rib portion is mountable thereon.

4. The terminal connection device according to claim 1, wherein an engagement portion of the first member is formed in a substantially cylindrical shape, and a counter engagement portion of the second member is formed so as to be engaged with the engagement portion so that the second member is rotatable with respect to the engagement portion, and wherein the first member is provided with a second rib portion formed on the rear end portion, and the second member is provided with a mounting regulation portion formed so that the second rib portion is mountable thereon.

* * * * *